US005104296A

United States Patent [19]

Roeder

[11] Patent Number: 5,104,296

[45] Date of Patent: Apr. 14, 1992

[54] ENGINE END FOR A DOWNHOLE HYDRAULICALLY ACTUATED PUMP ASSEMBLY

[76] Inventor: George K. Roeder, Box 807, Big Sandy, Tex. 75755

[21] Appl. No.: 577,390

[22] Filed: Sep. 4, 1990

[51] Int. Cl.[5] ..... F04B 17/00

[52] U.S. Cl. ..... 417/403; 417/404; 91/304

[58] Field of Search ..... 417/403, 404, 396, 397; 91/304

[56] References Cited

U.S. PATENT DOCUMENTS

| | | | |
|---|---|---|---|
| 2,081,223 | 5/1937 | Coberly | 417/404 |
| 2,311,157 | 2/1943 | Coberly | 417/404 |
| 2,631,541 | 3/1953 | Dempsey | 417/403 |
| 2,841,086 | 7/1958 | Deitrickson | 417/403 |
| 2,983,227 | 5/1961 | English | 417/403 |
| 3,078,804 | 2/1963 | McArthur et al. | 417/404 |
| 4,492,537 | 1/1985 | Awerkamp | 417/404 |
| 4,544,335 | 10/1985 | Roeder | 417/403 |
| 4,768,589 | 9/1988 | Roeder | 417/404 |

FOREIGN PATENT DOCUMENTS

| | | | |
|---|---|---|---|
| 2533835 | 2/1976 | Fed. Rep. of Germany | 417/396 |

*Primary Examiner*—Richard A. Bertsch

*Assistant Examiner*—Michael I. Kocharov

*Attorney, Agent, or Firm*—Marcus L. Bates

[57] ABSTRACT

A hydraulically actuated downhole pump assembly for producing a well is powered by a fluid that is pumped downhole to an engine end thereof. The pump assembly has a pump end which is connected to a source of formation fluid so that the engine end drives the pump end and the pump end lifts produced fluid to the surface of the ground. The pump end has a pump barrel and a pump piston is reciprocatingly received in sealed relationship within the pump barrel. The engine end has an outer engine barrel, and an annular valve element is reciprocatingly received in sealed relationship within the outer barrel. The valve element moves up and down between two positions of operation while an engine piston reciprocates within the annular valve element and in so doing aligns various flow passageways in a manner to alternately apply power fluid to appropriate sides of the piston and valve element to force the engine piston to reciprocate. The valve element shifts between the two alternate positions at the end of each of the engine piston strokes. This configuration of an engine end reduces the complexity of the engine end and allows loose tolerances to be used in fabricating the engine end.

17 Claims, 5 Drawing Sheets

ENGINE END FOR A DOWNHOLE HYDRAULICALLY ACTUATED PUMP ASSEMBLY

BACKGROUND OF THE INVENTION

A hydraulically actuated downhole pump assembly for producing a well is known to those skilled in the art, and takes on all sorts of different forms as evidenced by the cited patent to George K. Roeder, to which reference is made for further background of this invention. Reference is also made to the additional art cited in the Roeder patent. These various type production pumps are powered by a fluid that is pumped downhole to an engine which forms part of the pump assembly. Another part of the pump assembly is a pump which is connected to a source of formation fluid so that the engine drives the pump and the pump lifts or produces fluid to the surface of the ground.

The pump usually is located at the lower end of the pump assembly while the engine is usually located at the upper end of the pump assembly, so the upper end of the pump assembly is referred to as the engine end while the lower end thereof is referred to as the pump end, and the engine end together with the pump end make up the pump assembly.

The pump end has a pump barrel and a pump piston reciprocatingly received in sealed relationship within the pump barrel. The engine end has an outer engine barrel, and an engine piston is reciprocatingly received in sealed relationship within the engine barrel. A valve assembly is provided for controlling the various flow paths of fluid associated with the pump assembly.

The valve assembly heretofore has been spaced from the engine piston and includes a valve element that moves up and down between two positions in order to align various passageways of the engine end and pump end of the pump assembly in a manner to alternately apply power fluid to force the engine piston to reciprocate. A control rod is often used in prior art pump assemblies to shift the valve element between the two alternate positions at the end of each stroke of the engine piston. This configuration of a pump assembly can become very complex, and the engine end usually demands very close tolerances be used therein which calls for expensive fabrication techniques.

This invention provides improvements in the engine end of a downhole pump assembly and particularly a new and improved valve assembly for the engine end of a pump assembly, wherein the engine end has a valve assembly that receives an engine piston therein that is reciprocated by power fluid in a novel manner.

This patent application is directed to those skilled in the art, and particularly to one who comprehends the prior art cited herein.

SUMMARY OF THE INVENTION

This invention relates to an improved hydraulically actuated downhole pump assembly for producing a well in response to power fluid being pumped thereto. The pump assembly has an improved engine end. The engine end is controlled by a novel valve means by which said engine end can be operatively connected to a source of power fluid, whereby the flow of power fluid to the engine and the flow of spent power fluid from the engine is achieved in a new and novel manner.

The pump assembly has a pump end that is connected to a source of formation fluid. The pump assembly has a pump barrel, and a pump piston is reciprocatingly received in sealed relationship within said pump barrel. The pump assembly includes support means by which said engine end and said pump end can be mounted downhole in a borehole; and means by which produced fluid can be conducted uphole from the pump end.

More specifically, the engine end has an outer engine barrel, and an annular valve element is reciprocatingly received in sealed relationship within said outer barrel. The valve element is mounted to move axially from an uphole position of operation into a downhole position of operation respective to said barrel. An engine piston is reciprocatingly received in sealed relationship within said annular valve element; and means are provided for connecting the engine piston to the pump piston and thereby produce the well.

Flow passageway means are interconnected with the valve element for applying power fluid to said engine end to force said engine piston to move in an uphole direction, and to thereafter shift said valve element to the alternate position whereupon power fluid is applied to said engine to force said engine piston in a downhole direction and thereafter to shift said valve element to the alternate position.

One preferred embodiment of the invention is in a downhole pump assembly having an engine piston that has a control rod extending therefrom by which flow of power fluid is effected to shift the annular valve element into alternate positions in response to the position of the engine piston. The valve assembly of this invention controls flow of power fluid and spent power fluid to and from the engine end.

A primary object of the present invention is the provision of an improved downhole pump assembly having an engine end that includes a valve element that reciprocatingly receives an engine piston therein and is connected to reciprocate a pump piston for producing a wellbore.

Another object of the invention is to provide a downhole pump assembly that includes a combination engine, pump, and valve assembly; and wherein the engine has a piston that is reciprocatingly received within a valve element of said valve assembly.

A further object of this invention is to disclose and provide a downhole pump assembly that includes an engine end, a pump end, and a valve assembly connected to produce a wellbore, wherein a valve element of annular configuration reciprocatingly receives an engine piston therein, while the valve element shifts between two positions of operation, and thereby controls the operation of the pump assembly.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described herein.

DETAILED DESCRIPTION OF THE PREFERRED EMBODIMENT

Figure 1:
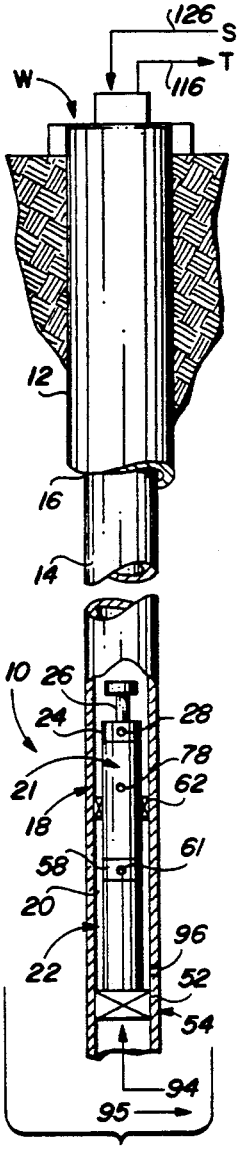
FIG. 1 is a part schematical, part diagrammatical, part cross-sectional, broken view of a well having a downhole pump assembly made in accordance with the present invention associated therewith.

FIG. 1 of the drawings discloses a wellhead W formed into the earth in a conventional manner and having flow lines connected to a source S of power fluid and to a tank battery T, for example, so that hydraulic fluid can be pumped downhole to a downhole hydraulically actuated pump assembly 10, made in accordance with the present invention, while produced fluid admixed with spent power fluid is pumped uphole to the surface of the ground and to the tank battery T. The well W includes the usual casing 12 and tubing string 14 that allow the pump assembly 10 to be circulated into and out of the well. The pump assembly 10 of FIG. 1 is located in a hydrocarbon producing payzone as seen in the detailed illustration of FIG. 3, for example.

Figure 3:
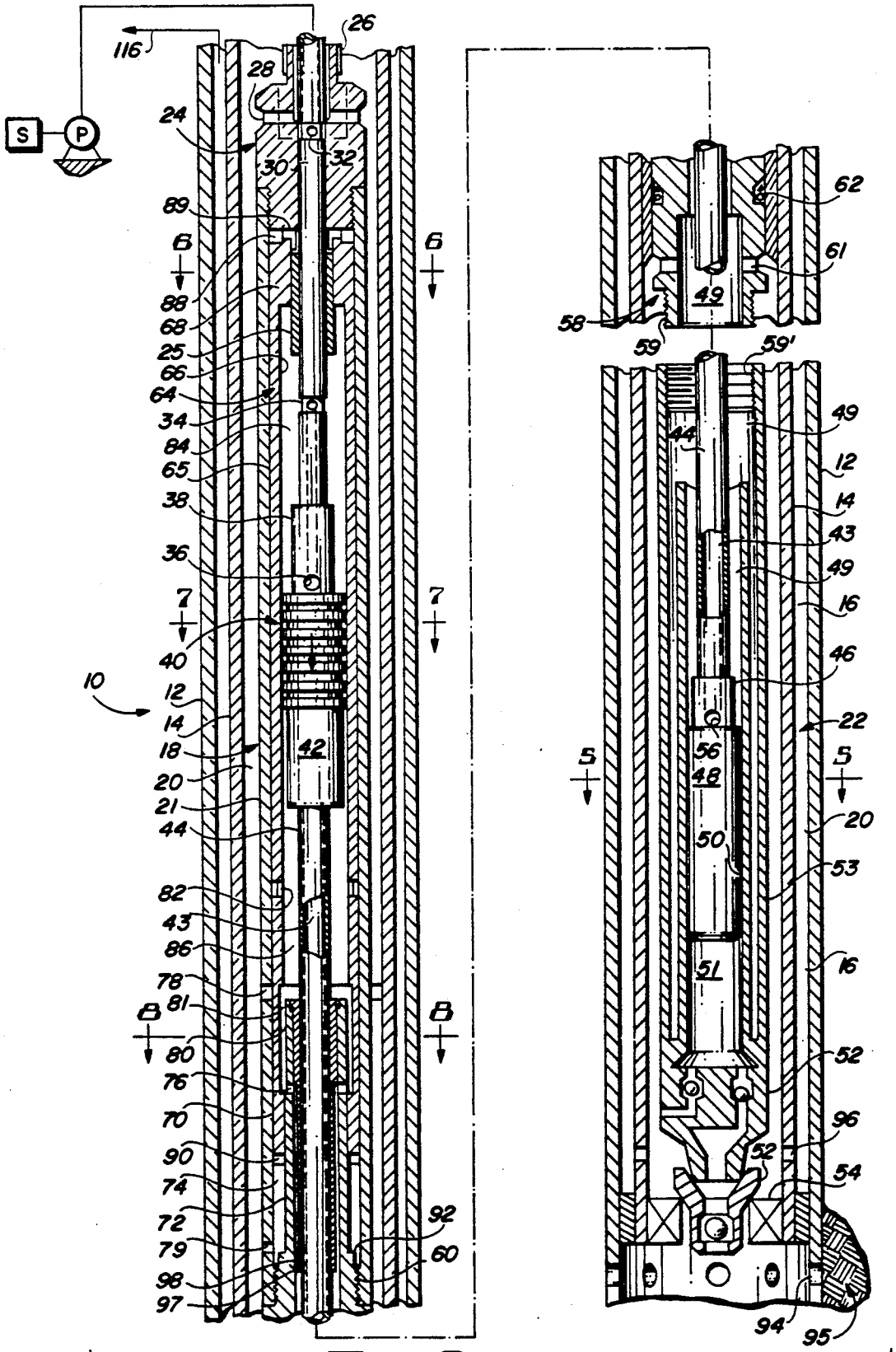
FIG. 3 is a fragmentary, longitudinal, part cross-sectional, detailed view of a pump assembly made in accordance with this invention.

In FIGS. 1 and 3, annulus 16 is formed between casing 12 and tubing string 14. The pump assembly 10 is seated in a conventional manner at the lower end of the tubing string 14. The pump assembly 10 is shown as a free type pump, however the pump assembly can be either the free or the fixed type as may be desired. Annulus 20 is formed between the pump assembly 10 and the interior wall surface of tubing string 14. The pump assembly 10 has an engine end 21 opposed to a pump end 22, with the upper extremity of the engine end 21 terminating in a connection 24.

As best seen in FIG. 3, connection 24 has a downwardly depending bushing 25 and an upwardly extending cylindrical power fluid inlet 26. Radial ports 28 extend from the connection 24 and communicate with the illustrated vertical, central, passageway of a control rod 30. The control rod 30 is slidably received in a sealed and reciprocating manner within an axial bore of the connection 24. The control rod 30 includes upper ports 32, middle ports 34, and main flow ports 36. Piston boss 38 upwardly extends from piston 40 while lower piston boss 42 downwardly extends from piston 40. An axial passageway 43 extends from the middle port 34, through the piston 40, and through a connecting rod 44 which is attached to boss 46 of pump piston 48 located within the pump end 22.

The pump end 22 includes a pump barrel 50 which reciprocatingly receives pump piston 48 in a slidable and sealed manner therein. The pump piston 48 divides the pump barrel 50 into an upper variable pump chamber 49 and a lower variable pump chamber 51. The lower end of variable pump chamber 51 terminates in a standing valve assembly 52, which can take on any number of different forms. An outer cylinder 53 is coaxially arranged respective to the pump barrel, both of which are attached at the lower end thereof and arranged to be removably received within a seating shoe and packer device 54, known to those skilled in the art. Port 56 interconnects axial rod passageway 43 with variable pump chamber 49. A connector 58 separates the engine end from the pump end and includes threads 59 formed thereon for threadedly engaging the complementary threaded surface 59′ of the pump end. The connector 58 threadedly engages the lower end of the engine barrel as indicated by numeral 60. Ports 61 are formed in connector 58 and communicate with port 56 by means of the upper variable chamber 49. Packer device 62 isolates the interior of the tubing string from annulus 20.

A combination valve element and engine cylinder 64 is slidably received in a reciprocating and sealed manner within the interior of the outer engine barrel 21. Numeral 65 indicates the interface between the outer cylindrical surface of the annular valve element and the inner cylindrical surface of the engine barrel. The combination valve element and engine cylinder 64 is of annular configuration, and could be referred to as a sleeve, but will hereinafter be referred to as the valve element 64. The valve element 64 has a cylindrical interior 66 that has an upper end opposed to a lower end, with the upper marginal end being reduced in diameter at end 68 and the lower marginal end being reduced in diameter as indicated by numeral 70, for purposes which will be more fully explained later on herein.

The before mentioned pump to engine connector 58 is reduced in outside diameter and thereby forms an upstanding extension 72. The extension 72 is an annular male member that slidably receives the reduced diameter end 70 of valve element 64 thereabout and also forms a variable working chamber 74 with respect to a medial length of the lower interior part of the outer engine barrel 21. The lower working variable chamber 74 accommodates the lower end 70 of the valve element 64. The extension 72 includes radial ports 76 formed therein at a location slightly above the reduced diameter marginal length that is adjacent end 70 of the valve element 64. Ports 78 are formed in a medial part of the engine barrel at a location adjacent the upper terminal end of the extension 72. Annular flow passageway 80 is formed between the indicated enlarged diameter part of the valve element 64 and forms an annular flow path for fluid flow from ports 76, while ports 82 that are formed through the sidewall of a lower medial length of the valve element 64 are in communication with the interior of the valve element.

The engine piston 40 divides the cylindrical chamber formed by the valve element 64 into an upper variable engine chamber 84 and a lower variable engine chamber 86. A variable working chamber 88 is formed between the lower end of connector 24 and the upper end of the valve element 64. The upper and lower ends of valve element 64 can be castellated to form a standoff between the connector 58 and the lower end of the valve element and between the connector 24 and the upper end of the valve element. Annular shoulder 92 formed on connector 58 abuttingly engages the end of the valve element 64 while a similar shoulder formed on connector 24 abuttingly engages the upper end of the valve element that forms valve element working chamber 88. The valve element working chambers 74 and 88 are opposed to one another and provide the means that forces the valve element to alternately reciprocate into abutment with the opposed connectors 24 and 58.

Casing perforations 94 communicate the interior of the casing with a payzone 95. Produced fluid outlet ports 96 communicate with casing annulus 16 and provide a flow path by which produced fluid exits at 116 above the ground.

Figure 2:
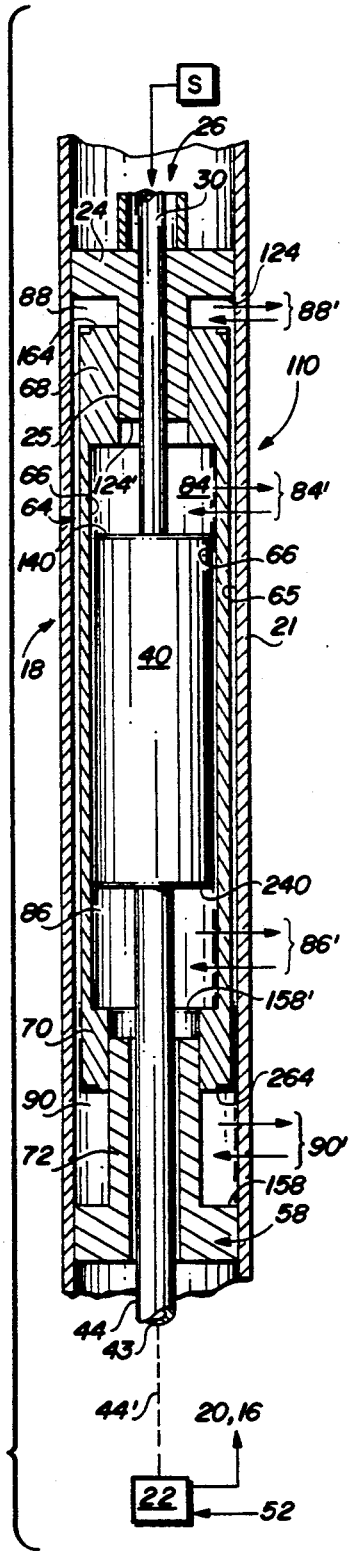
FIG. 2 is an enlarged, fragmentary, part cross-sectional, part diagrammatical representation of part of the apparatus of this invention.
Figure 5:
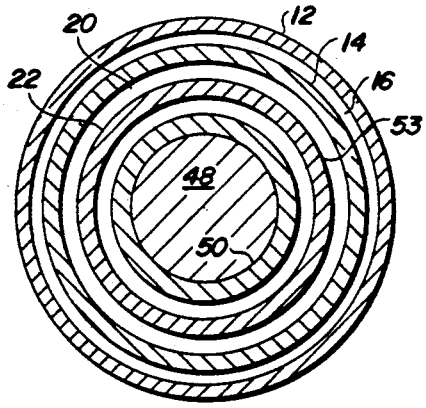
FIGS. 5 through 8, respectively, are cross-sectional views taken along lines 5—5, 6—6, 7—7 and 8—8, respectively, of FIG. 3.
Figure 6:
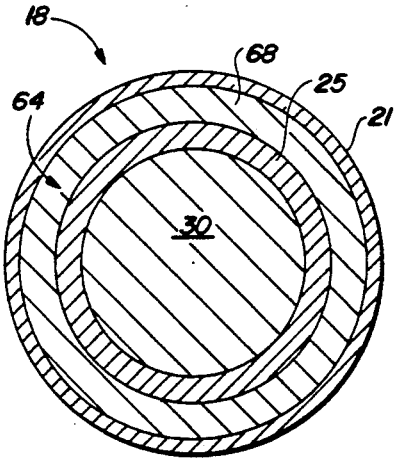
Figure 7:
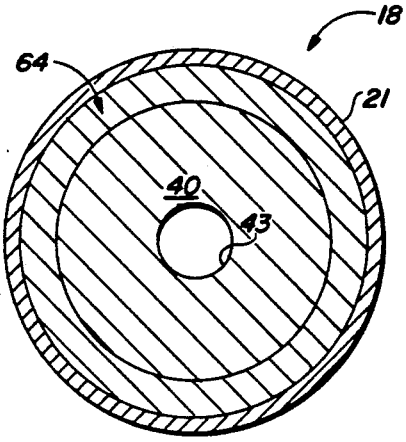

FIG. 2 of the drawings set forth a simplification of the invention that enables its principle of operation to be more readily appreciated. As seen in FIG. 2, the engine end 18 of a pump assembly 110 has an outer engine barrel 21 within which a combination valve element and engine cylinder 64 is reciprocatingly received. Upper and lower connectors 24 and 58 are affixed within the outer engine barrel and include extensions 25 and 72 which guidably receive the opposed ends 68 and 70 of the valve element 64, as shown. The upper end 164 of the valve element 64 abuttingly engages the lower shoulder 124 of upper connector 24, while the lower end 264 of the valve element 64 abuttingly engages shoulder 158 of the lower connector 58, and thereby limits the travel thereof and accurately positions the valve element in one of the two alternate positions. The extensions 25 and 72 of the upper and lower connectors 24 and 58 slidably receive the upper and lower marginal ends of the valve element 64.

This cooperative action of the various engine parts of FIG. 2 results in a number of variable chambers 84, 86, 88 and 90; each of which must be reckoned with as noted by the brackets 84', 86', 88' and 90' where fluid flows into and from the variable chambers as indicated, as well as power fluid flow at 26. Furthermore, pump end 22 (FIGS. 1 and 3) must receive formation fluid at 52 so that produced fluid flows uphole at 16. Hence, the pressure differential across the valve element and engine piston can advantageously be controlled by the flow passageways described in conjunction with FIG. 3 to cause the engine piston to be reciprocated in alternate directions, and for the valve and engine cylinder to be shifted in alternate directions, while the engine piston also reciprocates the pump piston, thereby providing a new and novel downhole pump assembly that advantageously produces a well in a new and different manner that is patentably distinct from the prior art.

Figure 15:
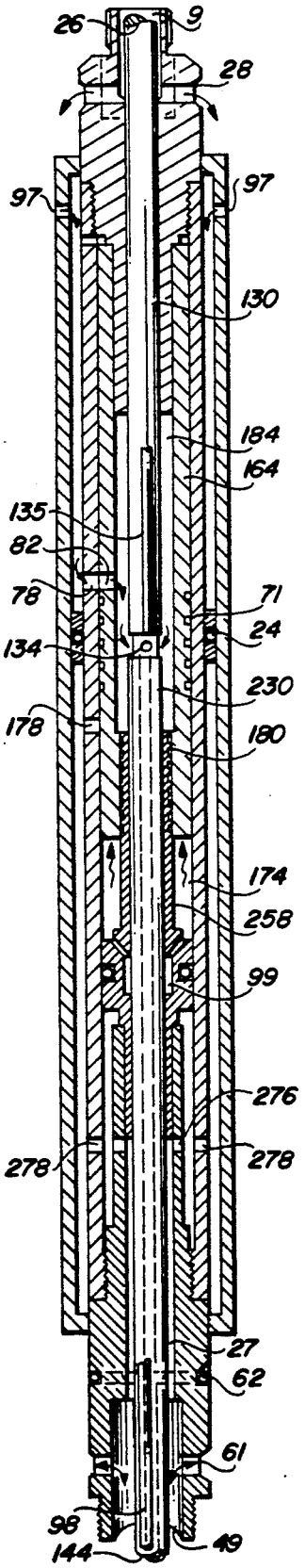
FIGS. 15–17 are longitudinal, part cross-sectional views of a second embodiment of the present invention.
Figure 16:
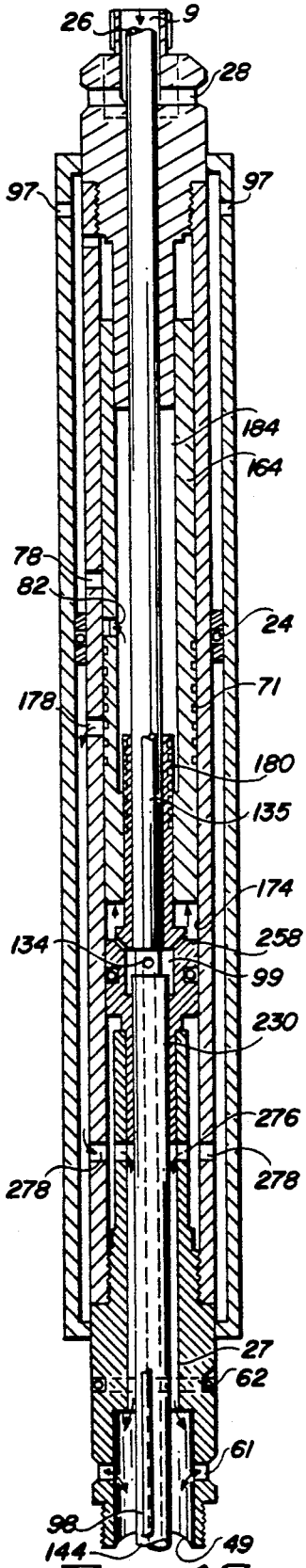
Figure 17:
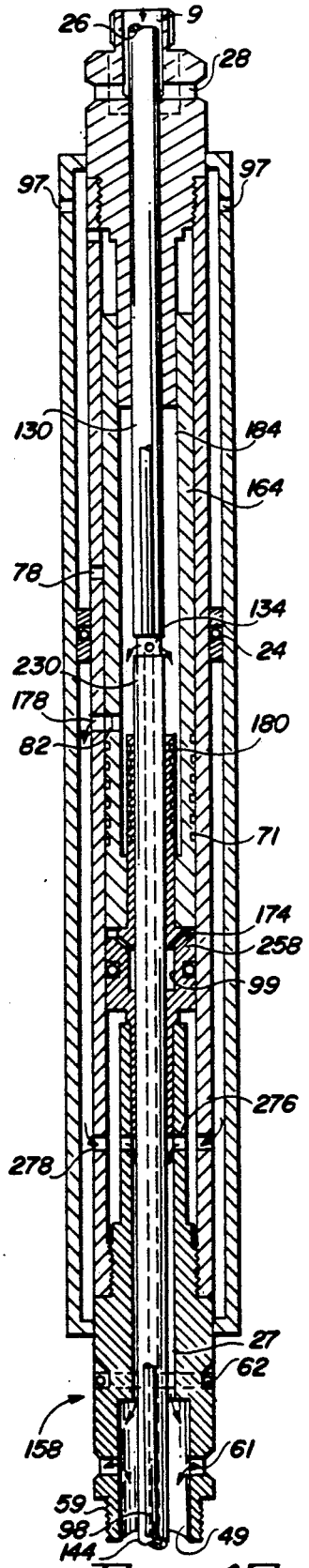

In operation, the downhole pump assembly 10 of the present invention is of the free type, for illustrative purposes, such as exemplified in FIG. 1, and which can therefore be circulated into and out of the tubing string 14 by fluid pressure. Alternatively, the pump assembly 10 can be fixed type, wherein an oil string can be substituted for the fishing neck at 26 and power oil supplied directly to the pump assembly by the oil string, in a manner known to those skilled in the art, as shown in FIGS. 15, 16, and 17. In any event, it is necessary to provide a source of power fluid to the power fluid inlet of the engine end of the pump, and to connect the pump end to a source of formation fluid, and further to provide a means by which the spent power fluid admixed with the produced fluid can flow along another separate flow path to the surface of the earth so that the power fluid invested into the system is returned along with sufficient produced fluid to make the entire process worthwhile.

The present invention, as seen diagrammatically illustrated in FIG. 2, is to a new combination of an engine, valve, and pump; and, therefore, includes an improved engine end 18 for a downhole pump assembly 10 that includes an outer engine barrel 21 having a hollow interior within which a very long combination valve element and engine cylinder 64 can reciprocate, with there being a cylindrical interior or bore 66 within the annular valve element 64 for reciprocatingly receiving an engine piston 40 therewithin.

This unique configuration of an engine end requires that the engine end be provided with a source of power fluid connected to flow passageway means arranged in a manner such that the piston 40 as well as the valve element 64 is reciprocatingly moved in timed sequence respective to one another and within the engine end and thereby provide power at shaft or connecting rod 44. In FIG. 2, it is evident that the various variable chambers 84, 86, 88 and 90 must be provided with inlet and outlet passageways as indicated by the arrows at numerals 84', 86', 88' and 90' in order that the valve element 64 is properly shifted from one to another of alternate positions at the proper time in response to the piston 40 reciprocating between two extreme positions of travel.

Figure 4:
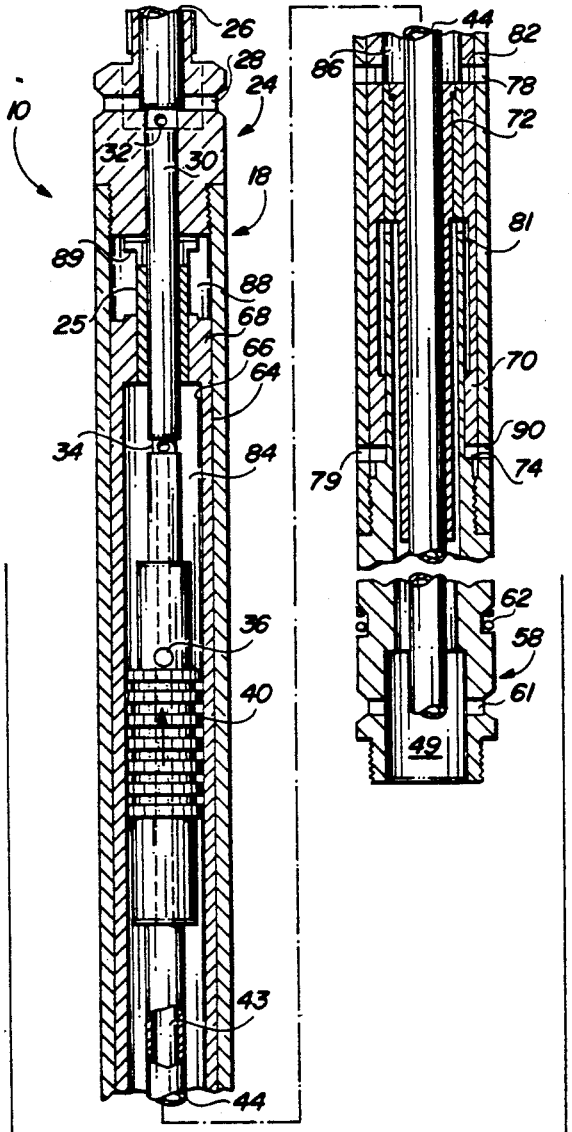
FIG. 4 is a fragmentary, longitudinal, part cross-sectional, detailed view showing part of the pump assembly of this invention in an alternate operative configuration.
Figure 8:
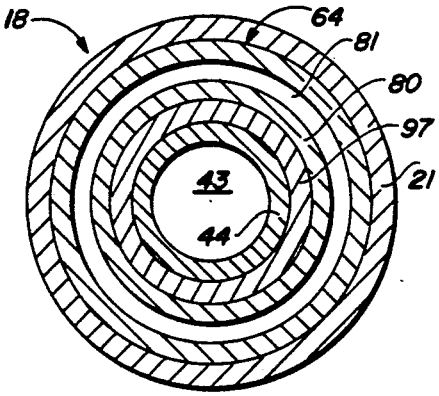
Figure 10:
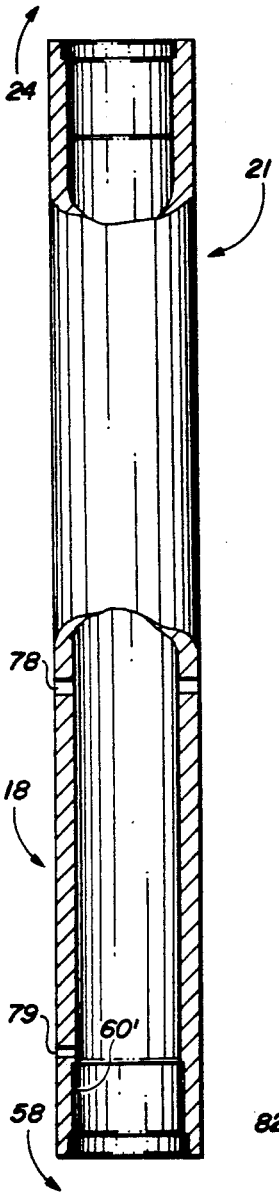
FIGS. 9–14 are enlarged, longitudinal cross-sectional representations of the details of some parts of the foregoing figures.
Figure 12:
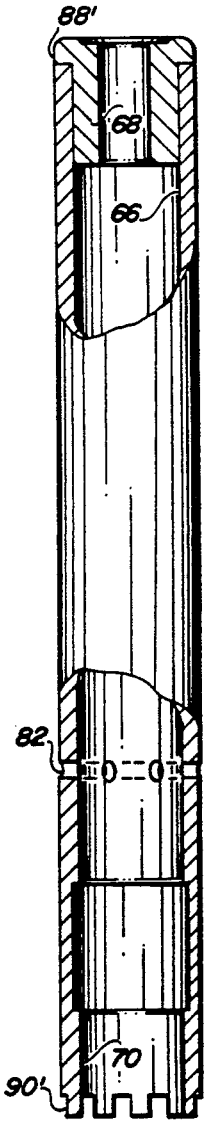
Figure 9:
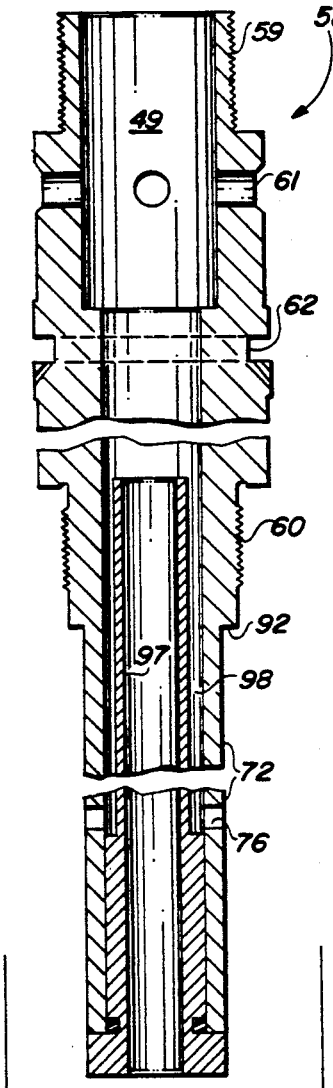
Figure 13:
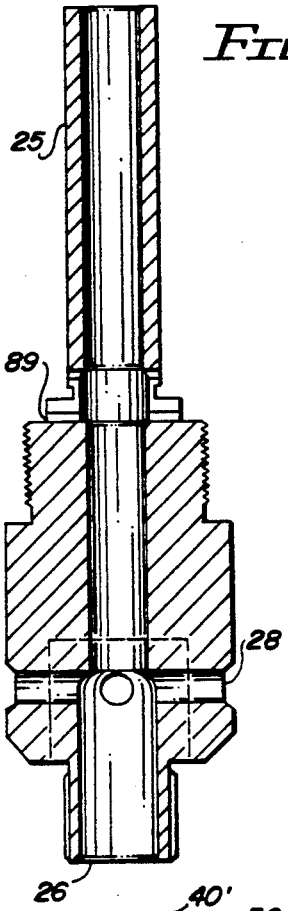
Figure 11:
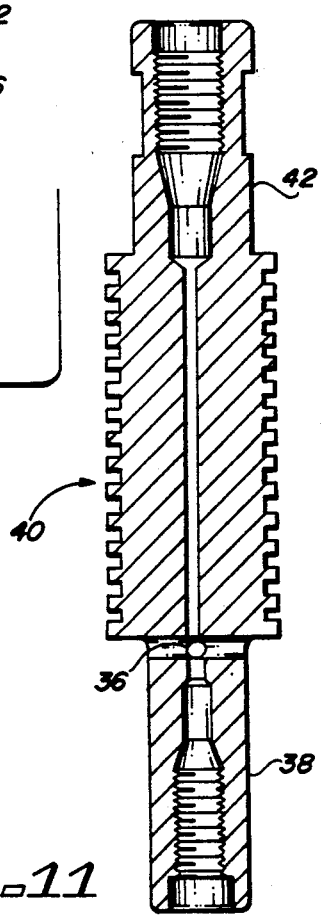

The engine end, as broadly seen in FIG. 2 and specifically illustrated in FIG. 3, has an outer engine barrel 21, an annular valve element 64 having an upper end 68 opposed to a lower end 70. The annular valve element 64 is reciprocatingly received in sealed relationship within the outer engine barrel 21 and is mounted to move axially from the upper position of operation, illustrated in FIGS. 2 and 3, into a lower position of operation, as illustrated in FIG. 4, respective to the engine barrel 21.

The engine piston 40 is reciprocatingly received in sealed relationship within the annular valve element 64 for movement from an uppermost position of travel to a lowermost position of travel respective to the engine barrel 21; and this range of travel is dependent upon the length of the interior bore 66 of the valve element 64 as well as the distance between the confronting faces of the piston 40 and the annular shoulder found at opposed ends of the bore 66, as well as the distance between the confronting faces of the opposed ends of the valve element 64 and the shoulders of the connectors 24 and 58 which abuttingly receive the opposed ends of the valve element. In any event, it is evident that the length of the bore 66 of the valve element must be at least as long as the stroke of the engine piston because this dimension necessitates the opposed ends of the piston abuttingly engaging the opposed ends of the bore 66 and any further stroke would require that both the piston and the valve element concurrently move within the barrel into abutting engagement with the opposed annular shoulders located on of the upper connector 24 and lower connector 58. Therefore the length of bore 66 is defined as being at least as long as the stroke of the piston 40; not the length of the engine barrel, because the piston 40 could abut the end of the valve element 64 and then both the piston 40 and valve element 64 would travel uphole or downhole into abutment with the appropriate connector 24 or 58.

Accordingly, the long valve element 64 directs the flow of power fluid into and from the appropriate variable chamber of the engine end as well as serving as a cylinder in which the engine piston reciprocates. Since the engine piston is contained within a cylinder which also functions as the control valve element, the control valve element must necessarily be as long or longer than the stroke of the hydraulic pump, and this novel arrangement provides unforeseen and desirable results. Most importantly, the valve element becomes an easily replaceable engine cylinder liner of simple construction that can be made to close tolerance for the inside bore that sealingly receives the reciprocating engine piston, while the outside diameter of the valve element need not be as critical or precise due to its length, which is relatively quite long, and therefore can be of loose tolerance respective to the interior of the engine barrel because the pressure drop from one end to the other is considerable. This also provides an engine end that can run for an extended time because of the loose tolerance acquired between the coacting parts thereof. There are many other unforseen advantages to be gained by the provision of an engine made in accordance with the teachings of this invention.

OPERATION OF THE EMBODIMENT OF FIGS. 3 AND 4

In FIGS. 3 and 4, the valve element 64 in the engine end 18 of the hydraulic downhole pump assembly 10 is disclosed in alternate positions. The valve element 64 directs flow of power to and from chamber 86 below the engine piston 40. The valve element 64 is made relatively long so that it also serves as the engine cylinder within which the engine piston 40 moves up and down. To have a control valve element 64 longer than the stroke of the hydraulic pump is novelty in itself. This heretofore unknown inventive concept reduces the precision normally required to fit any valve assembly into an engine end. Moreover, the lack of vertical holes in a valve element or body also reduces the time required for its manufacture.

In the illustrated free type pumping system set forth in FIGS. 3 and 4, the hydraulic engine is usually separated from the production end by an "O" ring seal located in tubing 14 and a co-acting seal member located within the pump, as shown at 62 in FIG. 3.

UPSTROKE (FIG. 4)

Power fluid flows down through inlet 26 and out ports 28, down the outside of the engine end, and enters aligned ports 78 and 82 while the valve element 64 is in the illustrated down position. This allows the engine piston 40 to be forced upward because power fluid is effected between the extension 72 and the engine piston 40. Fluid from engine chamber 84 is exhausted through port 36 and down through the inside passageway 43 of connecting rod 44, and out port 56 located above the production plunger 48 for passage out of port 61. The upper enlarged length adjacent end 68 of the long valve element 64 is sealed off by the outside surface of control sleeve 25. High pressure power fluid at chamber 88 above the large area at the upper end of the valve element during the previous downstroke will have been released when port 34 of the valve rod aligns with port 89 of the control sleeve 25. This action allows the high pressure fluid to flow into chamber 74 located at the lower and smaller area end of the long control valve element 64 by means of port 79 in the engine outer barrel.

DOWNSTROKE (FIG. 3)

The upward travel of the long valve element 64 allows annular chamber 81 to provide a passageway around packing seal 97. This seals off port 78, shutting off the power fluid from entering chamber 86. As the engine piston 40 moves downward, the fluid in chamber 86 is now allowed to flow around the packoff seal 97, through annular chamber 81, through 76, through annulus 98, and out of the pump assembly through port 61. This downward engine piston movement is a result of the force applied to the top end of the valve rod 30 by the power fluid at 26.

The downward movement of valve rod 30 through the seal of connector 24 allows port 32 in the valve rod to communicate with port 89 in the upper control sleeve 25. This alignment of ports permits the high pressure power fluid at inlet 26 to flow down into chamber 88 which is sealed off from chamber 84 by the close seal fit of the valve element about the outside diameter of control sleeve 25. This action forces the valve element in a downward direction. The chamber 88 will continue to increase in volume until the long valve element hits the valve stop shoulder at 92 on the lower connector 58. Thus the assembly is now ready for the upstroke. This up and down motion between the alternate positions of FIGS. 3 and 4 will continue until excessive wear eventually occurs within the engine end, or failure occurs somewhere within the production end.

The embodiments of FIGS. 15, 16 and 17 set forth several views of an engine valve assembly containing a long valve element which is adapted to be used to operate a single large engine piston or a multiple of large engine pistons in a subsurface hydraulic pump, such as seen in Roeder's U.S. Pat. No. 3,703,926, for example. The engine valve assembly preferably is fastened to the engine upper end by any suitable adaptor at lower connector 158.

In the operation of the embodiment of FIGS. 15–17, wherever it is logical or possible to do so, like or similar numerals will denote like or similar elements. The valve assembly of FIGS. 15–17 is for use in controlling flow of power fluid to and from a number of different engines, as seen for example in the downhole pump assembly of the Roeder U.S. Pat. No. 3,703,926, as shown in FIG. 18.

In FIGS. 15, 16 and 17, power fluid from the surface high pressure pump unit (P of FIG. 1) flows down the tubing string 14 or oil string (not shown) and into inlet 26, out through ports 28, and into passageway 97. This high pressure power fluid is contained within tubing 14 by means of a packoff seal at 62. Fluid flowing into passageway 97 flows down into ports 78 and 82, which have been brought into alignment with one another, as shown in FIG. 15; however, the undercut area 71 of port 82 has a flow path formed around valve element 164 for fluid passage, and through port 82 and then into valve element working chamber 184.

Figure 18:
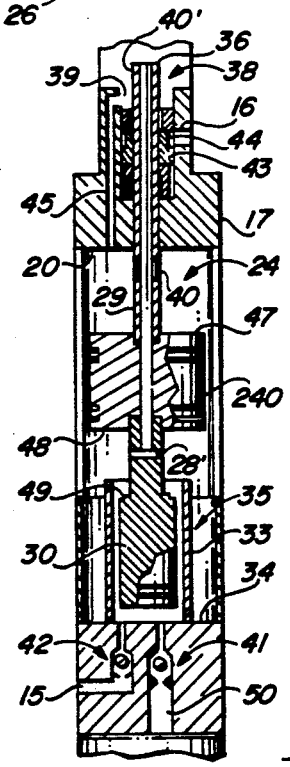
FIG. 18 (PRIOR ART)
FIG. 18 is a part diagrammatical, part schematical, part cross-sectional representation of a prior art pump end.
Figure 14:
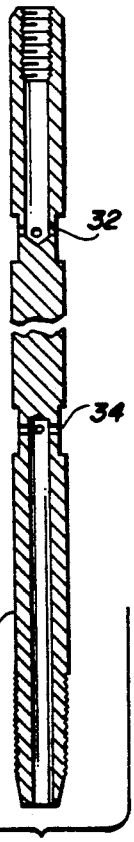

Fluid from chamber 184 flows down through valve rod 230 by means of port 134 and into the chamber below the engine piston 240 such as shown in FIG. 18, for example. The larger area of engine piston 240 of FIG. 18 is greater than the area at the top of the valve rod near inlet 26, thus allowing the engine piston 240 to continue its upward movement until undercut area 98 on the control rod 130 communicates chamber 99 with chamber 27, allowing the pressure to act on the top end of the long valve element 164 and thereby forcing the reduced pressured fluid trapped below the long valve element 164 in chamber 174 to flow out the exhaust passages. The long valve element will thus reach its lowermost position where it is abuttingly received against the valve stop of a smaller surface area near 174 which will provide an exposed area on the bottom of the valve element which is greater than the area on the opposed top end of the long valve element, to thereby provide a greater area and consequently a much larger force during the upward movement of the long valve element.

The valve element 164 in FIG. 17 has assumed its lowermost position. This aligns ports 178 and 82, and thereby connects chamber 184 to a relatively low pressure exhaust or discharge. The power fluid inlet port 78 is shut off in FIG. 16 while the valve element is shifting. Fluid from below the power piston in FIG. 18 is being forced out of its cylinder chamber and up through hollow connecting rod 144, out port 134, into chamber 84, and out through ports 82, 178, 278, 276, 27, and then out through port 61 and out of the pump assembly. This downward movement of the valve element continues because of continuation of the force applied to the top of rod 130 at 26.

Since there is no available supply of power fluid in FIGS. 15–17 to provide the necessary upward movement of the long valve element 164, the following novel arrangement is employed. As the rod system approaches the lower limit of its downward movement, the milled or undercut port 134 has moved into the inside of the control sleeve 258. Communication between chamber 184 and port 134 is interrupted, and with the continued force applied to the top of the valve rod at 26 the engine piston is forced to move downward against the trapped fluid, forcing the trapped fluid to flow up the hollow valve rod 144 and into chamber 99 where it then flows into chamber 174, thus applying a force against the lower or large area portion of the long valve element and thereby forcing ports 178 and 82 to move apart and into the closed position, as shown in FIG. 16. The fluid trapped in chamber 184 is allowed to flow out the spiral groove 71 formed on the lower outer surface of the long valve element. As the port 82 nears port 178, the spiral groove 71 forms a flow path which acts as a passageway of variable size that commences as a large size, reducing in size to almost non-existence upon port 78 and 82 communicating with one another, and thereby allowing a surge of high pressure fluid to flow through ports 78 and 82 and into chamber 184 to provide high pressure fluid in chamber 184 which flows between the long valve element and the control sleeve 258, through the spiral flow path 180, and into the chamber 174, thereby forcing the top of the valve element to move up against the valve stop as shown in FIG. 15. The upward speed of the valve element in a pump that is running in a range of 50–100 strokes/minute would usually be expected to reach the upper end of the stroke during the time of trapped fluid movement; however, the spiral groove 180 will replace any lost power fluid, assuring that the long valve element will remain against the small area of the valve stop. Thus, this unexpected advantage of the present invention makes the pump assembly ready for the next downstroke movement of the novel rod system.

Those skilled in the art recognize how to use the pump assembly of this invention as either a free or fixed type pump installation in a wellbore. A fixed type pump requires a special bottomhole assembly with seals or as shown in FIGS. 15–17 with an outer jacket.

I claim:

1. A hydraulically actuated downhole pump assembly for producing a well when power fluid is pumped thereto whereupon produced fluid admixed with spent power fluid is returned therefrom; said pump assembly has an engine end and a pump end and the pump end can be connected to a source of formation fluid, the pump end has a pump barrel within which a pump piston is reciprocatingly received in sealed relationship therewithin;

the engine end has an engine piston connected to actuate the pump end; said engine end having a valve assembly for controlling flow of fluid respective to the engine end and thereby reciprocate the engine piston which in turn reciprocates the pump piston whereby a well can be produced;

said engine end has an annular outer housing, said valve assembly includes an annular valve element reciprocatingly received in sealed relationship within said annular outer housing; said annular valve element moves axially between an uphole position and a downhole position respective to said annular housing;

said engine piston moves axially within said annular valve element between an uphole position and a downhole position respective to said engine barrel;

flow passageway means connecting said valve element for conducting flow of power fluid to said engine end to provide a force against said engine piston to move said engine piston in an uphole and downhole direction, whereupon said annular valve element is moved between an uphole and downhole position in response to the movement of said engine piston and conducts flow of power fluid to alternate sides of said engine piston to provide a force against said engine piston to reciprocate said engine piston.

2. A hydraulically actuated downhole pump assembly for producing a well in response to power fluid being pumped thereto; said pump assembly has an engine end, means by which said engine end can be connected to a source of power fluid; said pump assembly has a pump end; means by which said pump end can be connected to a source of formation fluid; and, means by which produced fluid can be conducted from the pump end;

said engine end has an outer engine barrel, said engine barrel has an upper end opposed to a lower end; an annular valve element having an upper end opposed to a lower end; said annular valve element is reciprocatingly received in sealed relationship within said engine barrel and said annular valve element is mounted to move axially from an upper position of operation into a lower position of operation respective to said engine barrel;

an engine piston reciprocatingly received in sealed relationship within said annular valve element for movement from an upper position of operation into a lower position of operation respective to said engine barrel; means connecting said engine piston to actuate said pump end;

flow passageway means for applying power fluid to said engine end to force said engine piston to move in an uphole direction when said annular valve element is in one of the recited positions of operation, and to thereafter shift said valve element to the other of the recited positions of operation, whereupon power fluid, when applied to said engine end forces said engine piston to reciprocate in a downhole direction.

3. The downhole pump assembly of claim 2 wherein said engine piston has a control rod extending therefrom which cooperates with said flow passageway means to move said valve element into alternate positions of operation in response to change in position of the engine piston.

4. The downhole pump assembly of claim 3 wherein said pump end has a pump piston and said engine end has a connector connected between the engine piston and the pump piston; said connector forms part of said flow passageway means to control flow of power fluid and spent power fluid to and from the engine end and to shift the valve element into alternate positions of operation.

5. The downhole pump assembly of claim 4 wherein said flow passageway means is connected to a power fluid source that is effected to lift the pump piston toward the upper end of said barrel and thereby move produced fluid out of the pump end.

6. The downhole pump assembly of claim 2 wherein said engine end has a connector interposed between the engine end piston and the pump end piston that controls flow of power fluid and spent power fluid to and from the engine end.

7. In a hydraulically actuated downhole pump assembly for producing a well in response to power fluid being pumped thereto; said pump assembly has an engine end which is adapted to be connected to a source of power fluid, and a pump end which is adapted to be connected to a source of formation fluid; the pump end has a pump barrel within which a pump piston is reciprocatingly received in sealed relationship therewith to lift fluid from the bottom of the borehole to the surface of the ground; the improvement comprising:

said engine end has an engine barrel, an annular valve element reciprocatingly received in sealed relationship within said engine barrel, said valve element is arranged to move axially between alternate positions that include an uphole position and a downhole position respective to said engine barrel; an engine piston reciprocatingly received in sealed relationship within said annular valve element; connecting means by which said engine piston can actuate the pump piston when the engine piston reciprocates;

flow passageway means including said valve element for applying power fluid to said engine end to force said engine piston to move in an uphole direction and to shift said valve element to one of the alternate positions; and, for controlling flow of fluid respective to said engine end to force said engine piston to move in a downhole direction and to shift said valve element to the other of the alternate positions.

8. The improved downhole pump assembly of claim 7 wherein said engine piston has a control rod extending therefrom by which power fluid can be connected to flow along said flow passageway means to shift the valve element between said alternate positions in response to movement of the engine piston.

9. The improved downhole pump assembly of claim 8 and further including means forming a connector that is located between the engine piston and the pump piston for controlling flow of power fluid and spent power fluid to and from the engine end.

10. The improved downhole pump assembly of claim 7 wherein said annular valve element, when in one alternate position, arranges the flow passageway means in one configuration to effect power fluid on the engine piston to move the pump piston uphole and thereby force produced fluid from the pump end.

11. The improved downhole pump assembly of claim 10 wherein said pump assembly has a connector between the engine piston and the pump piston that controls flow of fluid to and from the engine end.

12. A hydraulically actuated downhole pump assembly for producing a well wherein power fluid is pumped thereto and produced fluid admixed with spent power fluid is returned therefrom; said pump assembly has a pump end and the pump end can be connected to a source of formation fluid and further has a pump barrel within which a pump piston is reciprocatingly received in sealed relationship therewithin; the combination with said pump end of an engine end for driving said pump end and thereby reciprocate the pump piston whereby the well can be produced;

said engine end has an engine barrel, an engine piston having opposed sides, an annular valve element reciprocatingly received in sealed relationship within said engine barrel; said annular valve element moves axially between an uphole position in which power fluid is effected on one side of said engine piston and a downhole position respective to said engine barrel in which power fluid is effected on the other side of said engine piston;

said engine piston is reciprocatingly received in sealed relationship within said annular valve element; said engine piston moves axially between an uphole position and a downhole position respective to said engine barrel; means for connecting said engine piston to said pump piston;

flow passageway means for conducting power fluid flow to said engine end to provide a force against said engine piston to move said engine piston in an uphole direction and to shift said valve element between the uphole and downhole positions in response to the movement of said engine piston and for conducting fluid flow to said engine end to provide a force against said engine piston to shift said engine piston between the uphole and downhole positions.

13. The combination of claim 12 wherein said engine piston includes a control rod extending therefrom by which fluid is effected to shift the valve element into one of the recited positions in response to the change in position of the engine piston.

14. The combination of claim 12 wherein said engine end has a connector located between the engine piston and the pump piston that controls movement of the valve element to control flow of formation fluid, power fluid, and spent power fluid to and from the engine end and the pump end.

15. The combination of claim 12 wherein said engine piston has a control rod extending therefrom by which said power fluid is connected along said flow passageway means to shift the valve element between the recited alternate positions in response to the position of the engine piston.

16. The combination of claim 12 wherein means forming a connector is located between the engine piston and the pump piston for controlling movement of the valve element to control flow of power fluid and spent power fluid to and from the engine end.

17. The combination of claim 12 wherein said annular valve element arranges the flow passageway means in one configuration to effect power fluid on the engine piston to effect movement of the pump piston uphole and move produced fluid from the pump end.

* * * * *